US006212257B1

(12) United States Patent
Mattern et al.

(10) Patent No.: US 6,212,257 B1
(45) Date of Patent: Apr. 3, 2001

(54) MODULAR X-RAY RADIATOR SYSTEM

(75) Inventors: Detlef Mattern; Erich Hell, both of Erlangen; Peter Schardt, Roettenbach, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/306,178

(22) Filed: May 6, 1999

(30) Foreign Application Priority Data

May 7, 1998 (DE) ..... 198 20 427

(51) Int. Cl.[7] ..... H01J 35/10
(52) U.S. Cl. ..... 378/137; 378/125; 378/144
(58) Field of Search ..... 378/92, 101, 125, 378/131, 144

(56) References Cited

U.S. PATENT DOCUMENTS 4,788,705 11/1988 Anderson ..... 378/121
5,086,442 2/1992 Gemmel et al. ..... 378/132
5,703,926 12/1997 Bischof ..... 378/200
5,822,395 10/1998 Schardt et al. ..... 378/137
5,883,936 3/1999 Hell et al. ..... 378/125
6,084,942 * 7/2000 Hell et al. ..... 378/200

* cited by examiner

*Primary Examiner*—David P. Porta
*Assistant Examiner*—Allen C. Ho
(74) *Attorney, Agent, or Firm*—Schiff Hardin & Waite

(57) ABSTRACT

A modular X-ray radiator system includes at least one base X-ray radiator with a rotating bulb tube with a cathode that emits an electron beam, an anode, and an arrangement for variably deflecting the electron beam and for adjustment of the size of the focal spot of the electron beam on the anode, and a number of drive mechanisms of varying drive powers which can be selectively attached to one of the base X-ray radiators for the rotating of the rotating bulb tube.

10 Claims, 1 Drawing Sheet

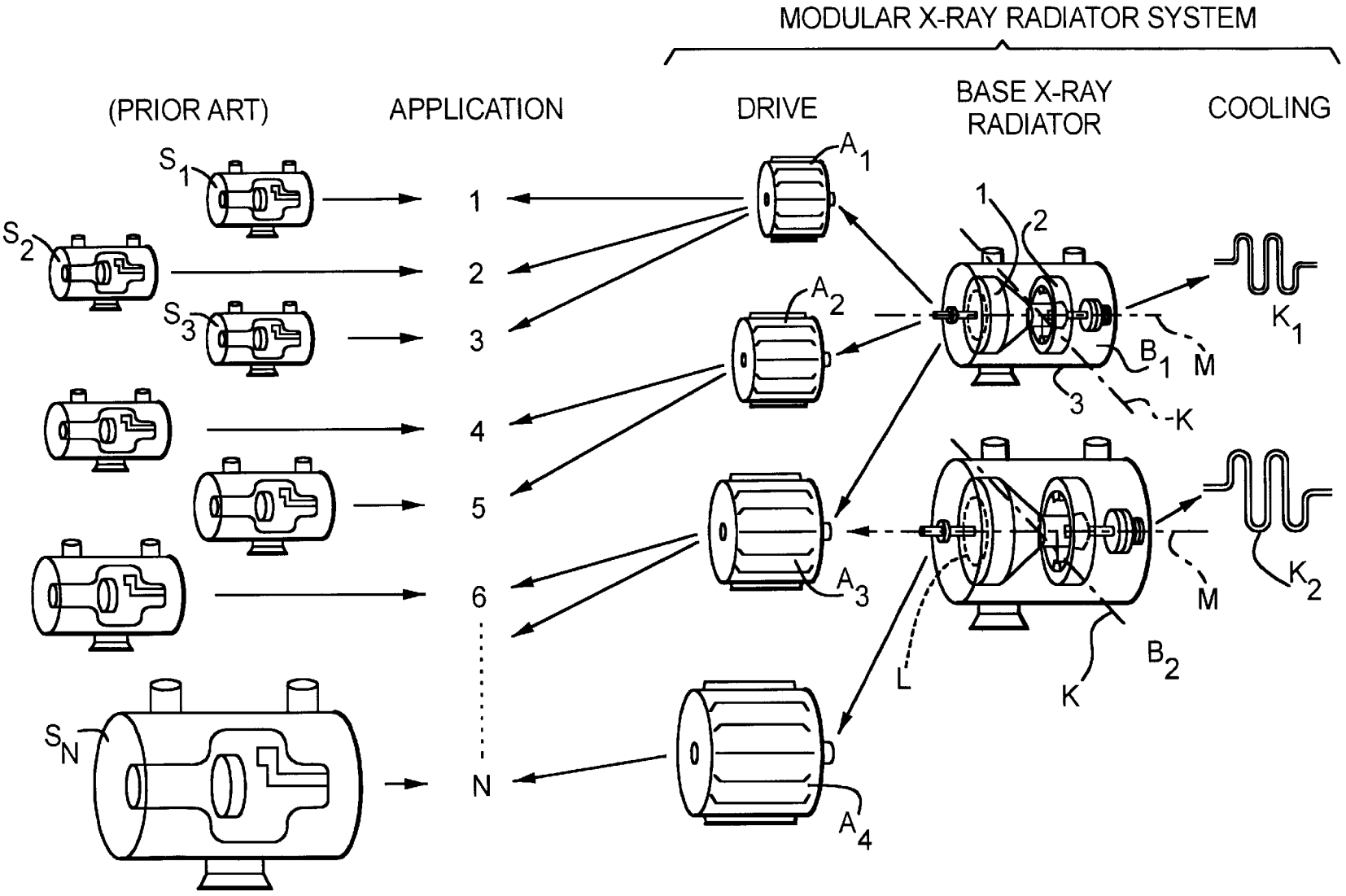
MODULAR X-RAY RADIATOR SYSTEM
COOLING
BASE X-RAY RADIATOR
DRIVE
APPLICATION
(PRIOR ART)
K1
K2
M
B1
B2
K
L
1
2
3
A1
A2
A3
A4
1
2
3
4
5
6
N
S1
S2
S3
SN

MODULAR X-RAY RADIATOR SYSTEM

BACKGROUND OF THE INVENTION

1. Field of the Invention The present invention is directed to a modular system for use in assembling an x-ray radiator, the assembled x-ray radiator being of the type having a radiator housing, containing an x-ray tube, and a drive attachable to the x-ray tube for rotating the x-ray tube.

2. Description of the Prior Art X-ray radiators are used for a wide variety of purposes today, the foremost being various medical examinations in the framework of X-ray analysis or material examinations. For practically each individual application—for example, in the framework of medical technology—there is a particular type of X-ray tube which differs from other types for other applications with respect to the requirements. This results in a number of different X-ray radiator types for different performance classes, with which different focal spots are generated on the anode plate. The different focal spots are adapted to different detector formats or are produced on different anode materials. The wide variety of types necessarily results in low piece numbers for each X-ray radiator type, which has a disadvantageous effect on the material and manufacturing costs of each X-ray radiator and on the automation level in the manufacturing procedure.

SUMMARY OF THE INVENTION

An object of the present invention is to reduce the wide variety of X-ray radiator types without limiting the applications, so that a cost reduction is possible.

The object is achieved in an X-ray radiator system having at least one type of base X-ray radiator, with a rotating bulb tube with a cathode that emits an electron beam, an anode, and an arrangement for adjusting the size of the focal spot of the electron beam on the anode, and a number of drives of varying drive power for rotationally driving the rotating bulb tube, being selectively attachable to the base X-ray radiator.

The inventive X-ray radiator system preferably provides for the use of only one or a few types of base X-ray radiator(s), which are quasi-standardized types which, in contrast to known X-ray radiators, are not designed for a specific purpose, e.g. with respect to X-ray power and focal spot size. Rather, these types of base X-ray radiators each have a rotating bulb tube with an arrangement for adjusting the size of the focal spot. It is thus possible to adjust the size of the focal spot to account for application-specific requirements. Given the use of a specific type of base X-ray radiator, a wide range of different focal spots can be generated which are suitable for a variety of applications. An advantage of the rotating bulb tube used in the invention is that the heat loss arising during the operation (only about 1% of the electrical power which is fed to the rotary piston tube is converted into X-rays), which limits the X-ray power and the application range of the X-ray radiator, is conveyed, via the anode dish that acts as cooling block, to a cooling medium which is situated inside a radiator housing that surrounds the rotating bulb tube and which serves for cooling the tube. The maximum power loss to be dissipated in the form of heat is essentially determined by the product of the average radius of the anode dish and the angular velocity of the anode dish, the latter being determined by the type of drive mechanism of the rotating bulb tube. This means that, given a low power loss to be dissipated, a correspondingly low-power type of drive mechanism is sufficient, while for applications in which higher X-ray powers are demanded, and thus a greater power loss occurs, a higher-power type of drive mechanism is used to achieve a higher angular velocity. The weaker the type of drive mechanism is, the fewer its costs, so that an appreciable reduction of types and of costs can be achieved by a suitable selection, in connection with the suitable type of base X-ray radiator, of a drive mechanism type which fits the particular application and the required X-ray power. A modular X-ray radiator system is thus described herein from which a number of different X-ray radiators can be constructed, the type of base X-ray radiator and of drive mechanism to be respectively utilized being selected specifically for the application and the X-ray power.

Different designs for rotating bulb tubes are described in U.S. Pat. Nos. 5,883,936; 5,703,926; U.S Pat. No. 5,086,442 and U.S Pat. No. 4,788,705. The disclosure of these documents and the disclosure of co-pending United States Application filed simultaneously herewith having U.S. Ser. No. 09/306,099 are hereby incorporated herein by reference.

In an embodiment of the invention, the X-ray radiator system can include a number of types of base X-ray radiators of different X-ray powers (preferably two), to which any one of a number of drive mechanism types can be attached in order to cover the total requirement range from low-end X-ray examination apparatuses to high-end X-ray examination apparatuses. It has proven advantageous if at least one drive mechanism type of a specific drive power can be attached to different types of base X-ray radiators; i.e., one type of drive mechanism, of a specific drive power, which permits high angular velocities given a type of base X-ray radiator of low X-ray power, can likewise be coupled to a type of base X-ray radiator of high X-ray power in order to cover the range of low angular velocities.

To further increase the variety of possibilities within the X-ray radiator system, in another embodiment of the invention a cooling arrangement can be selectively attached to at least one type of base X-ray radiator. Whether to use such a cooling arrangement at all, and the design and/or cooling power thereof (if used), are dependent on the particular application and on the required X-ray power. A cooling arrangement such as a heat exchanger can be used alternatively to the utilization of a stronger drive mechanism type; i.e., it is possible to likewise achieve high X-ray powers with a weakly dimensioned type of drive mechanism in combination with a cooling arrangement. Given a number of types of base X-ray radiators, for at least one X-base radiator type of low or average X-ray power, a gaseous cooling medium can be employed in the cooling arrangement instead of a liquid cooling medium. In types of base X-ray radiators of low or average X-ray power, the use of a gaseous cooling medium suffices to dissipate the heat. This has the advantage that the rotating bulb tube can be rotated with appreciably less friction; i.e., a weaker drive mechanism type can be utilized, which in turn lowers the costs.

For adjustment of the size of the focal spot, a focusing electrode which is allocated to the cathode can be provided, in conventional fashion, this electrode being supplied with a focusing voltage which determines the size of the focal spot. In a variation of the invention, the arrangement for adjusting the size of the focal spot can be a magnet system. It is then possible to adjust the size of the focal spot in the manner described in the aforementioned co-pending U.S. application Ser. No. 9/306,099, for example.

In order to be able to move the focal spot to a position on the anode as is needed for the particular application of the X-ray radiator, in an embodiment of the invention at least one type of base X-ray radiator has an arrangement for deflecting the electron beam, which is preferably a magnet system. If an arrangement for deflecting the electron beam is used, then according to another variant of the invention at least one type of base X-ray radiator can have an anode into which at least two radially spaced, different target materials are deposited onto which the electron beam can be selectively guided by the beam deflecting arrangement, so that different X-ray spectra can be produced as needed.

To be able to adjust the anode angle, i.e. the angle between the primary direction of propagation of the X-rays and the region of the anode which contains the focal spot, the rotating bulb tube is mounted so that it can be tilted inside the radiator housing. This tilting enables the selection of an anode angle which corresponds to the particular application, it being possible, given the use of an arrangement for adjusting the size of the focal spot and an arrangement for deflecting the electron beam, to adapt the dimensions of the focal spot to a particular anode angle. A known magnet system which generates a dipole field with a superimposed quadrupole field is suitable for the adjustment of the size of the focal spot and for the deflection of the electron beam.

The inventive X-ray radiator system is a modular X-ray radiator system which, using one or a few types of base X-ray radiators, permits an optimized, application-specific adaptation by means of modularly attachable external components, with only a few types of individual components being necessary.

DESCRIPTION OF THE DRAWINGS

The single FIGURE is a schematic comparison of a state of the art X-ray radiator and the inventive modular X-ray radiator system, including a representation of various assembly possibilities afforded by the inventive system.

DESCRIPTION OF THE PREFERRED EMBODIMENTS

As can be seen in the left side of the FIGURE, a number of specifically designed conventional X-ray radiators $S_1$,$S_2$, $S_3$, . . . . $S_N$ are respectively needed for different applications 1,2,3, . . . N in the medical field, in material research or in production technology, for example. The X-ray radiators $S_1$. . . $S_N$ respectively differ in their X-ray power, and with respect to the focal spots which can be generated, the effective anode angles, the angular velocities of the anode plates (in the case of rotary anode X-ray tubes), the target materials, etc.; that is, each X-ray radiator $S_1$. . . $S_N$ is built and designed specifically for a particular application. The X-ray radiators $S_1$. . . $S_N$ are thus not mutually compatible, or are so only to an extremely slight degree. The required variety of types is thus rather large.

This does not apply to the inventive modular X-ray radiator system. In the example depicted in the right side of the FIGURE, this modular system includes only two types of base X-ray radiators $B_1$, $B_2$, each of which is constructed so as to be standardized, to the extent of not being designed for a specific application. Both the base X-ray radiator of type $B_1$ and the base X-ray radiator of type $B_2$ have a rotating bulb tube 1 (which is not illustrated in detail herein but is described in detail in U.S. Pat. No. 5,883,936) with an anode, in the form of an anode dish, and a cathode, as well as electron optics for variably adjusting the size of the focal spot of the electron beam on the anode. In addition, the rotating bulb tube 1 has a magnet system 2, which generates a dipole field with a superimposed quadrupole field and which serves for deflection of the electron beam onto the anode dish and for adjustment of the shape and size of the focal spot. The rotating bulb tube 1 is mounted in a surrounding radiator housing 3 such that it can be rotated around its center axis M (broken line in the FIGURE), while the deflection system 2 is arranged fixedly in the radiator housing 3. The radiator housing 3 is filled with a cooling medium. In the case of the base X-ray radiator of type $B_1$, which is designed for lower and average X-ray powers, this is a gaseous cooling medium. In the case of the base X-ray radiator of type $B_2$, which is designed for high X-ray powers, a liquid such as cooling oil is provided as the cooling medium.

The rotating bulb tube 1 is mounted in the radiator housing 3 such that it can be tilted around the axis K (broken line) extending transversely to the center axis M, so that it is possible to modify the effective anode angle in the manner described in U.S. Pat. No. 5,822,395 by tilting the rotating bulb tube 1.

In the case of one type of base X-ray radiator, namely type $B_2$, the anode has two regions of different target materials which are arranged concentrically to the center axis M, which fact is indicated in the FIGURE by a broken line, referenced L. Depending on which of these regions onto which the electron beam is guided by the deflection system 2, two different X-ray spectra can be generated.

Different types of drives $A_1$,$A_2$,$A_3$,$A_4$ can be selectively coupled to each type of base X-ray radiator $B_1$,$B_2$. The drives $A_1$–$A_4$, preferably electromotors, serve for the rotation of the rotating bulb tube 1 in the cooling medium. The velocity achievable by the cooling medium at the heat "exit surface" of the rotating bulb tube 1, which corresponds to the bottom of the anode dish, is the limiting factor for the removable heat loss and is thus limiting for the X-ray power of the X-ray radiator. The type of drive is selected among drives $A_1$–$A_4$ corresponding to the desired application. In the case of the application 1, a drive mechanism of type $A_1$ is attached to a base X-ray radiator of type $B_1$. The drive $A_1$ only permits relatively low angular velocities of the rotating bulb tube 1 and thus of the anode dish, but this is sufficient for application 1. For applications 2 and 3, also, a drive of type A, is attached to a base X-ray radiator of type $B_1$, although, in the case of these applications 2 and 3, a different shape and size of the focal spot, or a different effective anode angle, is selected by adjustment. In any case, the three applications 1 to 3 can be covered in the case of the exemplary embodiment by the combination of a base X-ray radiator of type $B_1$ with a drive mechanism of type $A_1$, in combination with the adjustment possibilities which are available for the base X-ray radiator of type $B_1$. This requires only one type of base X-ray radiator and one type of drive, while in the prior art, three completely different X-ray radiators $S_1$,$S_2$ and $S_3$ are required to cover the same applications 1, 2 and 3.

For the applications 4 and 5, a drive of type $A_2$ is attached to a base X-ray radiator of type $B_1$. The applications 4 and 5 can differ in terms of effective anode angles or the like, which can be adjusted, in connection with the focal spot adjustability, by the electron optic and the deflection system 2 without complications, in combination with the tiltable mounting of the rotating bulb tube 1 inside the radiator housing 3.

For applications which also require higher X-ray powers compared to the applications 1 to 5, and consequently higher angular velocities at the anode plate, a drive of type $A_3$ is attached, as long as the maximum permitted X-ray power of a base X-ray radiator of type $B_1$ still suffices. In cases where a higher X-ray power is needed, a base X-ray radiator of type $B_2$ is used. Different types of drives can also be attached to this; the selected number of four different drives is of course not limiting, additional drive mechanisms being available. Here, too, the drives that suffices for the desired application is attached.

In the case of the exemplary embodiment, the inventive modular X-ray radiator system covers a wide range of applications with only two essentially standardized types of base X-ray radiators, which permit varying of the focal spot, and four different types of drives which can be selectively attached to these.

As the FIGURE also shows, one of two types of cooling arrangements $K_1$,$K_2$ can be selectively attached to both types of base X-ray radiators $B_{1,B2}$ if the desired application so demands. For these types of cooling arrangements $K_1$,$K_2$, which can be heat exchangers, corresponding connection mechanisms are provided at the radiator housing 3 in the case of both types of base X-ray radiators $B_1$,$B_2$. These connection mechanisms are constructed such that one or the other type of cooling mechanism $K_1$,$K_2$ can be selectively attached. The type of different cooling medium (gaseous or liquid) is taken into account in the cooling arrangement selection and connection mechanism. The possibility to selectively attach different cooling arrangements further increases the variation possibilities of the inventive modular X-ray radiator system.

Departing from the exemplary embodiment, both or at least one type of base X-ray radiator $B_1$, $B_2$ can be constructed on the basis of rotating bulb tubes which are not as described in U.S. Pat. No. 5,883,936, but otherwise, such as in the manner described in U.S. Pat. No. 5,086,442 or U.S. Pat. No. 4,788,705.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray radiator system comprising:

at least one base X-ray radiator containing a rotating bulb X-ray tube having a cathode which emits an electron beam, an anode on which said electron beam is incident at a focal spot for producing X-rays, and an arrangement for adjusting a size of said focal spot on said anode; and a plurality of drives of different drive types, each drive type having a different drive power, selectively attachable to said rotating bulb X-ray tube for rotating said rotating bulb X-ray tube.

2. An X-ray radiator system as claimed in claim 1 comprising a plurality of base X-ray radiators of respectively different X-ray powers, each of said X-ray radiators in said plurality of X-ray radiators being selectively respectively attachable to a drive in said plurality of drives.

3. An X-ray radiator system as claimed in claim 2 wherein each of said base X-ray radiators is selectively attachable to more than one drive in said plurality of drives.

4. An X-ray radiator system as claimed in claim 1 further comprising a plurality of cooling arrangements selectively attachable to said at least one base X-ray radiator.

5. An X-ray radiator system as claimed in claim 4 wherein each of said cooling arrangements comprises a heat exchanger.

6. An X-ray radiator system as claimed in claim 1 wherein said arrangement for adjusting the size of the focal spot comprises a magnet system.

7. An X-ray radiator system as claimed in claim 1 wherein said at least one base X-ray radiator comprises an arrangement for deflecting said electron beam in a propagation path between said cathode and said anode.

8. An X-ray radiator system as claimed in claim 7 wherein said arrangement for deflecting the electron beam comprises a magnet system.

9. An X-ray radiator system as claimed in claim 7 wherein said anode comprises an anode dish having at least two radially spaced regions respectively comprised of different target materials, deposited into said anode dish, onto which said electron beam can be selectively guided by said arrangement for deflecting the electron beam.

10. An X-ray radiator system as claimed in claim 1 wherein said at least one base X-ray radiator has a radiator housing, and a mount in said radiator housing for mounting said rotating bulb tube therein allowing tilting of said rotating bulb tube in said housing.

* * * * *